US006860799B2

(12) United States Patent
Loveless

(10) Patent No.: US 6,860,799 B2
(45) Date of Patent: Mar. 1, 2005

(54) VACUUM DRIVEN SANDER

(76) Inventor: Michael L. Loveless, 600 S. Nick La., Price, UT (US) 85401

( * ) Notice: Subject to any disclaimer, the term of this patent is extended or adjusted under 35 U.S.C. 154(b) by 0 days.

(21) Appl. No.: 10/384,760

(22) Filed: Mar. 11, 2003

(65) Prior Publication Data

US 2004/0180616 A1 Sep. 16, 2004

(51) Int. Cl.[7] ..... B24B 23/00

(52) U.S. Cl. ..... 451/354; 451/344; 451/456; 451/523; 451/524

(58) Field of Search ..... 451/344, 354, 451/456, 523, 524

(56) References Cited

U.S. PATENT DOCUMENTS

| | | | | |
|---|---|---|---|---|
| 1,800,341 | A | | 4/1931 | Davies |
| 3,468,076 | A | | 9/1969 | Jones |
| 3,722,147 | A | | 3/1973 | Brenner |
| 3,785,092 | A | | 1/1974 | Hutchins |
| 4,052,824 | A | | 10/1977 | Hutchins |
| 4,062,152 | A | | 12/1977 | Mehrer |
| 4,184,291 | A | | 1/1980 | Marton |
| 4,399,638 | A | | 8/1983 | Rodowsky, Jr. |
| 4,616,449 | A | | 10/1986 | Marton |
| 4,697,389 | A | | 10/1987 | Romine |
| 4,782,632 | A | | 11/1988 | Matechuk |
| 4,905,420 | A | | 3/1990 | Flachenecker et al. |
| 5,007,206 | A | | 4/1991 | Paterson |
| 5,018,314 | A | | 5/1991 | Fushiya et al. |
| D326,398 | S | | 5/1992 | Fushiya et al. |
| 5,144,774 | A | | 9/1992 | Conboy |
| 5,185,544 | A | | 2/1993 | Takada |
| 5,193,313 | A | | 3/1993 | Sanchez et al. |
| 5,228,244 | A | | 7/1993 | Chu |
| 5,283,988 | A | | 2/1994 | Brown |
| D351,976 | S | | 11/1994 | Morey et al. |
| D353,313 | S | | 12/1994 | Stiles |
| 5,384,984 | A | | 1/1995 | Smith |
| 5,540,616 | A | * | 7/1996 | Thayer ..... 451/354 |
| D375,885 | S | | 11/1996 | Taylor |
| 5,582,541 | A | | 12/1996 | Hutchins |
| 5,595,530 | A | | 1/1997 | Heidelberger |
| 5,605,500 | A | | 2/1997 | Matechuk |
| 5,624,305 | A | | 4/1997 | Brown |
| 5,637,034 | A | | 6/1997 | Everts et al. |
| D392,861 | S | | 3/1998 | Gildersleeve et al. |
| 6,347,985 | B1 | | 2/2002 | Loveless |

* cited by examiner

*Primary Examiner*—Joseph J. Hail, III
*Assistant Examiner*—Shantese McDonald
(74) *Attorney, Agent, or Firm*—M. Reid Russell

(57) ABSTRACT

The invention is in a vacuum driven sander that is appropriate for drywall sanding, that utilizes a vacuum flow pulled therethrough to drive a turbine that includes an adjustable lock mounting through a bearing assembly to an eccentric to turn the eccentric that is connected to oscillate a sanding pad that mounts a section of sanding material, and that vacuum air flow also provides for removing sanded particles off from the sanded surface that are transported through the sander and a connected pipe or hose into a catchment container. The sander housing includes a pole mounting cylinder that projects outwardly from a housing top surface and is ported with equal spaced radial cavities formed around the port, and with a selected pair of cavities to receive each of a pair of stub axles of a pivot collar, providing a first pivot coupling that, along with a second pivot mounting of the collar to the end of a hollow bent tube, provides a universal coupling of the hollow bent tube to the sander body that allows for the pivoting of the sander whereby the sanding surface remains in engagement with the wall as it is moved up and down and across the wall. The hollow bent tube also includes a static discharge electrical connector that receives a female connector fixed to an end of a conductive wire for positioning in a sander pole that is mounted to the bent tube end, with the wire extending the length of the pole wherethrough the vacuum exhaust flow passes and conducts a static electric charge into the vacuum flow.

8 Claims, 5 Drawing Sheets

VACUUM DRIVEN SANDER

BACKGROUND OF THE INVENTION

1. Field of the Invention

This invention pertains to sanding devices, and in particular to a vacuum driven light weight sander that can be hand held or mounted onto a pole for use in sanding dry wall and is attached to a vacuum hose that provides motive power to drive the sander and for removing sanding dust off of a wall surface that is pulled into a collection canister.

2. Prior Art

The present invention is in improvements to a vacuum driven sander as embodied in U.S. Pat. No. 6,347,985 issued to the present inventor. The vacuum driven sander of the '985 patent constitutes a marked improvement over earlier sanders. With some examples of such earlier sanding devices are shown, in U.S. utility patents to Brenner U.S. Pat. No. 3,722,147; to Mehrer U.S. Pat. No. 4,062,152; to Marton U.S. Pat. No. 4,184,291; to Rodowsky, Jr. et al. U.S. Pat. No. 4,399,683; to Romine U.S. Pat. No. 4,697,389; to Paterson U.S. Pat. No. 5,007,206; to Sanchez, et al. U.S. Pat. No. 5,193,313; to Brown U.S. Pat. No. 5,283,988; to Matchuk U.S. Pat. No. 5,605,600; and to Brown U.S. Pat. No. 5,624,305. Also, the vacuum driven sander of the '985 patent is unique and distinct from certain other electric motor driven devices that connect through a hose to a vacuum or suction device like those shown in U.S. Patents to Davies U.S. Pat. No. 1,800,341; to Jones U.S. Pat. No. 3,468,076; to Hutchins U.S. Pat. No. 3,785,092; to Hutchins U.S. Pat. No. 4,052,420; to Matechuk U.S. Pat. No. 4,782,632; to Flacheneck, et al. U.S. Pat. No. 4,905,420; to Fushiya et al. U.S. Pat. No. 5,018,314; to Takada U.S. Pat. No. 5,185,544; to Chu et al. U.S. Pat. No. 5,228,224; to Smith U.S. Pat. No. 5,384,984; to Hutchins U.S. Pat. No. 5,582,541; to Heidelberger U.S. Pat. No. 5,595,530; to Everts, et al. U.S. Pat. No. 5,637,034; and in Design Patents to Taylor No. Des. 375,885; to Gildersleeve et al. No. Des. 392,861; to Fushiya et al. No. Des. 326,398; to Morey et al. No. Des 351,976; and to Stiles No. Des. 353,313. None of which earlier sanding devices prior to that of the '985 patent of the inventor, however, included a vacuum driven oscillating sanding disk that provided for the efficient and reliable removal of sanded particles from the work surface through an attached vacuum hose.

Somewhat similar to the vacuum driven sander of the '985 patent are U.S. Patents to Brenner U.S. Pat. No. 3,722,147; to Rodowsky, Jr. et al. U.S. Pat. No. 4,399,638; and to Marton U.S. Pat. No. 4,616,449, that show sanding devices where an oscillating plate mounts a sheet of sand paper, is air driven by a vacuum flow and also provides for removal of sanding dust off from a work surface to pass that collected dust through a vacuum hose into a collection container. However, while the patent to Rodowsky, Jr. et al., U.S. Pat. No. 4,399,638 provides a turbine blade that is turned by a vacuum flow to operate an oscillating plate whereto a section of sanding material is attached, calls for pulling that sanded dust through the turbine bearing, thereby greatly limiting bearing life. Which inherent flaw was recognized and corrected in the '985 patent of the inventor.

The '985 patent of the inventor provides a vacuum driven sander where the turbine bearings are protected from exposure to the dust laden vacuum flow and, as further unique features, includes a balanced split-air intake that providing a balanced driving force to the turbine blades, drawing essentially equal air flows from both sides of the sander and also improves upon the entrainment of dust and contaminants in the air flows as are passed through the sander. Further, the turbine of the '985 patent is itself an improvement over earlier devices in that it incorporates a split design where the top and bottom turbine sections are not symmetrical, with the lower turbine section having the greater height to allow the bearings and bearing supports to be conveniently fitted inside the turbine mounting section in the sander housing, providing a turbine housing profile that is shorter than former sanders turbines and has a lower center of gravity as compared to earlier sanders.

The '985 patent also provided an improved pole coupling assembly that allows the angle of a pole whereon the vacuum driven sander is mounted to be changed to accommodate a selected sander top surface to a wall allowing the body to be moved up and down over a wall, but does not provide a universal type joint arrangement that allows the sander body to be easily tilted both up and down and side to side relative to its mounting pole. While a ball coupling of a pole end to head is shown in U.S. Pat. No. 5,144,774 to Conboy, the coupling is not a universal type coupling like that of the invention. Nor does the '985 patent provide for dissipation of a static electrical charge as the contact of an oscillating sander surface creates, and further fails to provide for tightly locking the sander turbine onto a top end of a bearing assembly that supports the turbine and its connected eccentric. Which deficiencies in the '985 patent are addressed and solved by the improvements of the present invention.

SUMMARY OF THE INVENTION

It is a principal object of the present invention to provide an improved vacuum air driven turbine operated sander that includes a coupling arrangement that allows the sander head to be pivoted freely, both in the vertical and horizontal axis, as it is moved across a wall.

Another object of the present invention is to provide for the elimination of a buildup of a static electricity charge as is produced during sander operations from contact of the sanding face with a wall surface.

Another object of the present invention is to provide a bolt and nut locking arrangement for tightly coupling a sander head turbine onto a bearing assembly, allowing for setting and holding a desired torque on the coupling, providing improved sander functioning.

Another object of the present invention is to provide, as the mechanism for allowing the sander head to be moved in both the vertical and horizontal axis across a sander pole end is a universal joint type joint arranged on a hollow bent pole mount fitted between the sander housing head and pole whereby the head can be easily and conveniently tilted side to side and up and down relative to the pole end without a disruption of a seal between the head and pole end as could compromise a vacuum air flow through the pole.

Still another object of the present invention is to provide a vacuum sander head and pole arrangement whereby a static electric charge as builds up on the sander housing and pole during sanding operations is directed through a static charge eliminator that extends from the sander head and into the pole wherethrough the vacuum flow passes, dissipating that charge into the passing flow.

Still another object of the present invention is to provide a vacuum sander turbine and bearing mount where the turbine, bearing assembly and eccentric are held together with a nut and bolt type connection arrangement to hold the components together at a set torque value.

Still another object of the present invention is to provide a vacuum driven sander that is light in weight and is convenient to connect to a vacuum hose, with the vacuum air flow to both reliably turn an oscillating plate or pad of the sander head and to draw collected dust from the sander head through an open pole for passage to a collection container.

The present invention is in an improved vacuum air flow air driven oscillating sander and sander pole, with the sander head including a bent hollow pole mount that connects through a universal type joint to an end of a hollow pole that is connected to a hose to pass a vacuum air flow therethrough and into a collection container. The bent hollow pole mount is preferably a tube having a ball end section formed on one end and is bent at less than a right angle a distance therealong from which ball section end. Lugs are formed to extend outwardly from opposite sides of which ball end section that are for fitting into ears formed to extend outward and parallel from a top edge of a curved collar lower portion that is to fit over, as a seat, the ball end section of the bent hollow pole mount. The curved collar ears each have a hole therethrough that align to individually receive each of the pair of ball end section lugs, forming a pivot coupling therebetween. Further, the curved collar itself includes a pair of stub axles that each project outwardly from an opposite side of the curved collar upper end section, with each stub axle and lug, respectively, being spaced ninety degrees apart. The improved vacuum sander housing includes a dome that is externally threaded, includes a vertical port or opening therethrough and flat top surfaces wherein spaced radial cavities are formed around which port or opening to receive the stub axles. The spaced radial pivot cavities individually receive each of the pair of stub axles fitted therein and a collar having a center opening is turned thereover to contain the stub axles in the selected pivot cavities, forming pivot mountings of which stub axles. So arranged, the lugs mounted to the collar ears and the stub axles fitted in the spaced radial cavities provide a universal joint that allows the sander head to pivot up and down pivot and across the pole end.

In operation, a static electricity charge is built up in the sander body and travels into the pole during sander operations by contract of the sanding surface and wall surfaces, This charge is dissipated by an inclusion of a conductive wire connected at one end to an electrical contact formed in the sander bent hollow pole mount and is fitted into the pole, extending along its length. The static electric charge as is built up thereon during sanding operation is dissipated into the vacuum flow rather than building up on the sander and pole surfaces to be discharged through an operator.

For providing a secure mounting of the sander eccentric to a turbine bearing assembly and the turbine, the invention includes a threaded rod secured to extend out from a top surface of the eccentric that is fitted through the turbine bearing assembly and passes through the turbine top to receive a locking nut fitted and turned thereover. The locking nut is turned to a determined torque value against the turbine top surface, sandwiching the bearing assembly between the turbine and eccentric, and, after the tool is operated to brake it in, the nut is re-torqued to a final set torque value.

Still other benefits and advantages of the invention will become apparent to those skilled in the art to which it pertains upon a reading and understanding of the following detailed specification.

DESCRIPTION OF THE DRAWINGS

The invention may take physical form in certain parts and arrangements of parts, and a preferred embodiment of which will be described in detail in this specification and illustrated in the accompanying drawings which form a part hereof.

DETAILED DESCRIPTION

Figure 1:
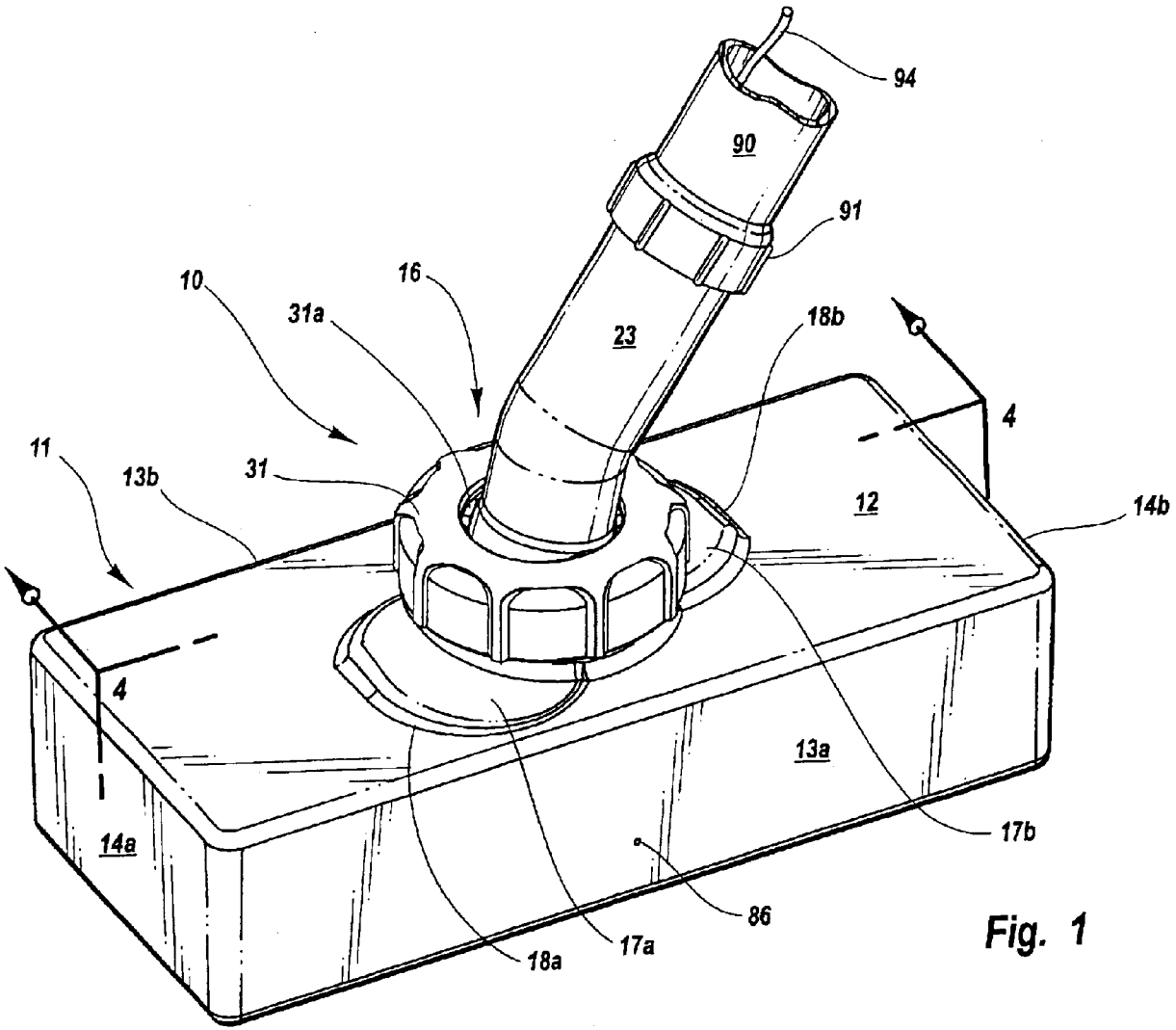
FIG. 1 is a perspective view taken from a left side and front of a vacuum sander of the invention, showing a bent hollow pole mount extending out from a sander housing top section collar and cap and showing a pole end mounted to the bent hollow pole mount that has been broken away and exposes a static electricity charge dissipater within the pole.
Figure 3:
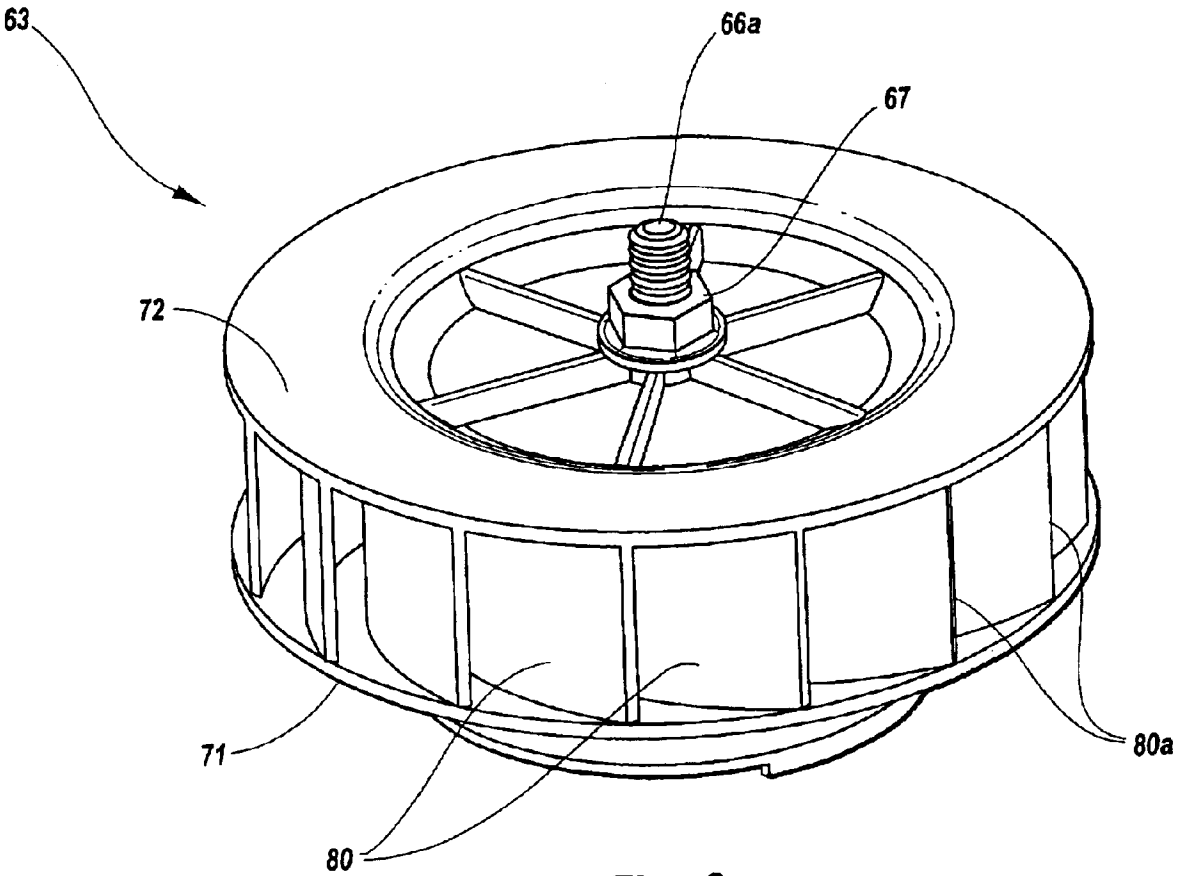
FIG. 3 is a top plan sectional view taken along the line 2—2 of FIG. 2 of the turbine showing a lock nut turned over the threaded rod end against the edge of the turbine center hole.
Figure 4:
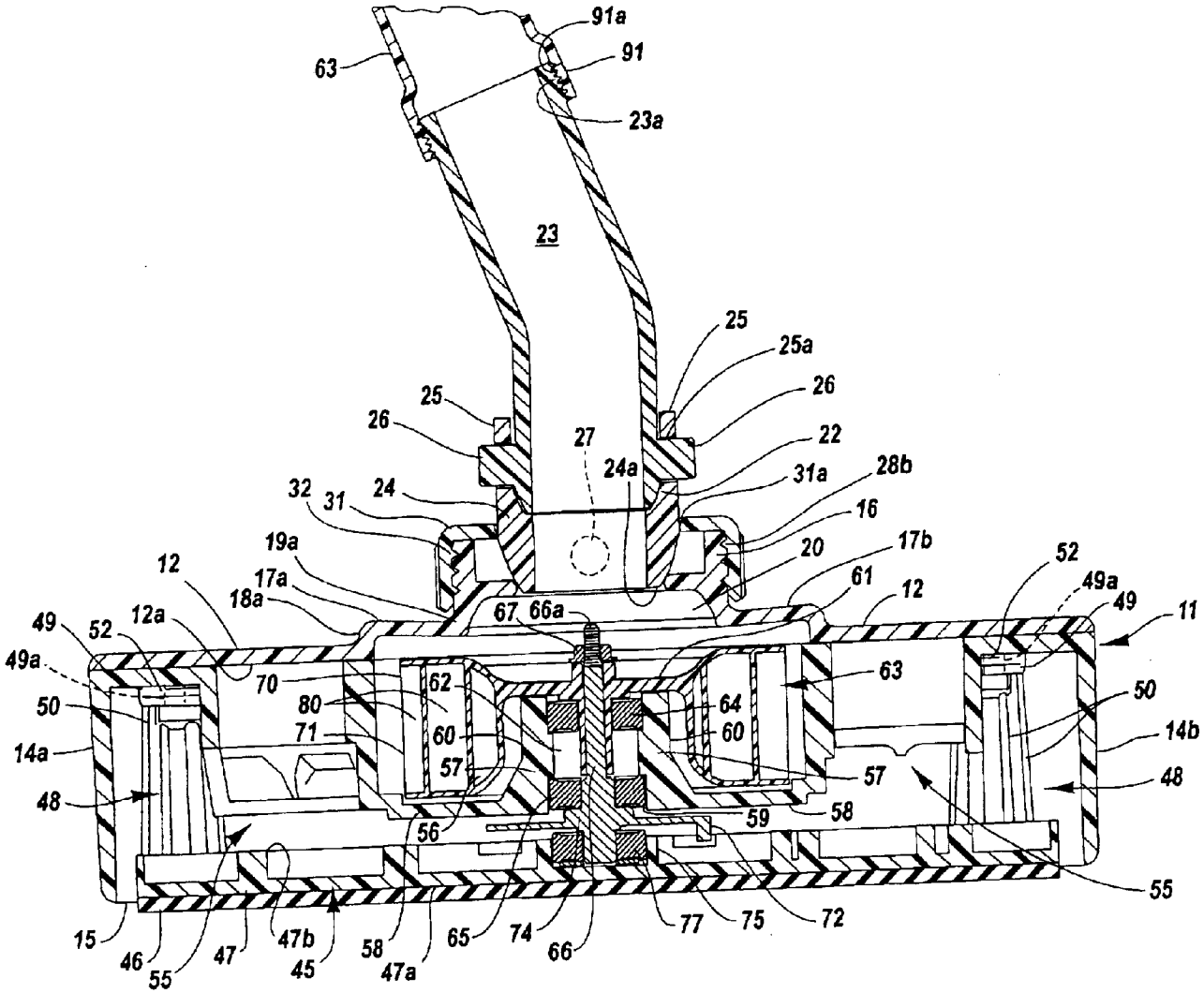
FIG. 4 is a front elevation sectional view taken along the line 4—4 of FIG. 1.

The invention is herein described with reference to a preferred embodiment shown in the accompanying drawings, with FIG. 1 showing a front elevation perspective view of the low profile vacuum driven sander 10 of the invention, hereinafter referred to as sander. As shown in the Figs., the sander 10 includes a housing 11, having front, rear and side walls 13*a*, 13*b*, 14*a*, and 14*b*, respectively, extending at right angles downwardly from a housing top edge, forming an inverted narrow rectangular box configuration having, as shown in FIG. 4 an open bottom 15. A coupling collar assembly 16 that is open therethrough is shown in FIGS. 1,3 and 4, fitted into the center of the top 12 that includes, as shown in FIGS. 2 and 5, a pair of turbine ducts 17*a* and 17*b* that are shown as flat raised sections that extend oppositely from steps 18*a* and 18*b* to an opening in the center of the flat top 12, and open into the coupling collar assembly, as shown in FIG. 4, to serve as ducts to pass and direct a turbine exhaust air flow through the collar assembly that enters a hollow bent tube 23 that is preferably bent at an angle of approximately twenty two and one half (22½) degrees, and passes the vacuum flow therethrough that travels into a pole 90.

Figure 2:
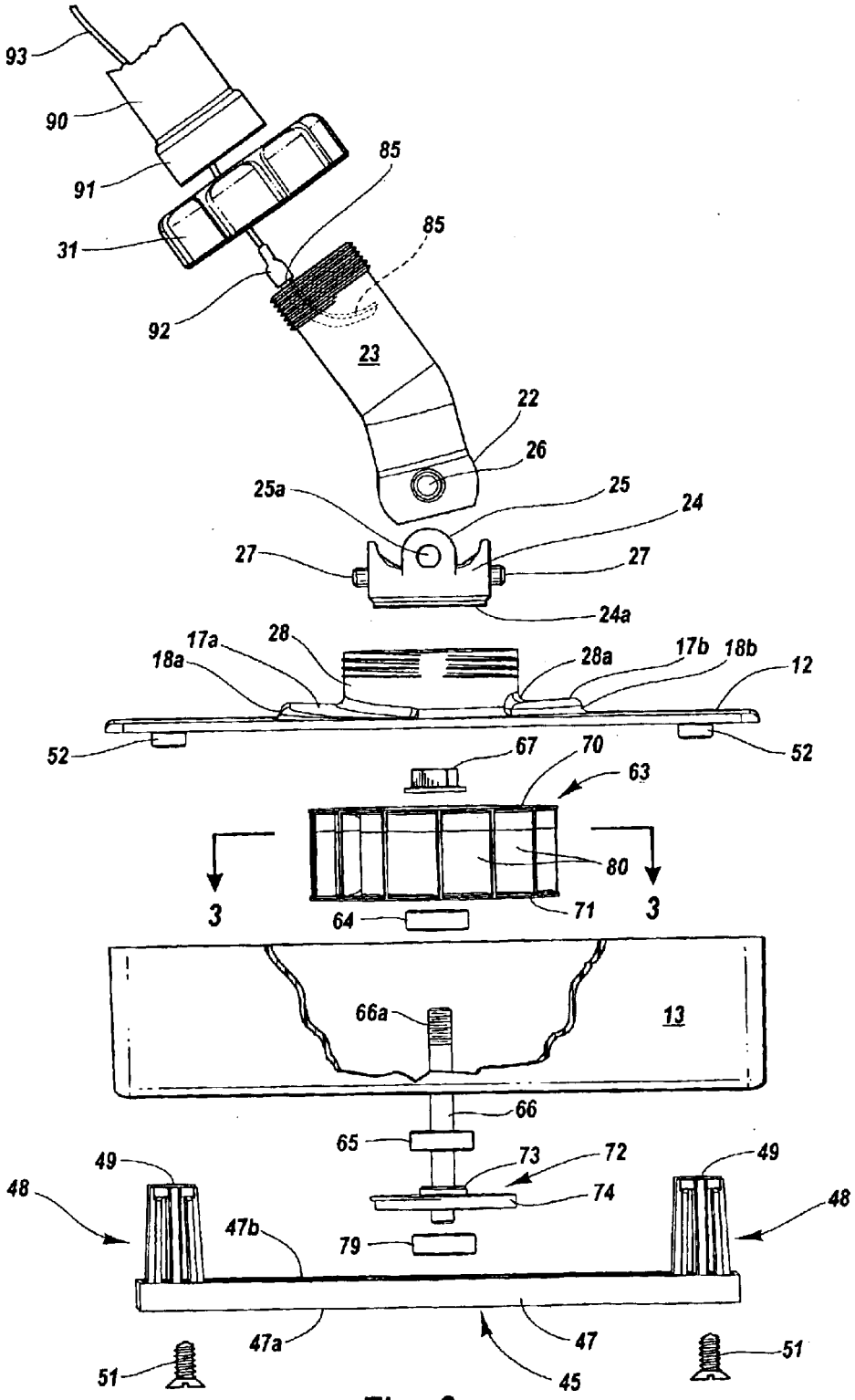
FIG. 2 shows a side elevation exploded view of the vacuum sander of FIG. 1, with the pole broken away, exposing the static electricity charge dissipater extending from its electrical coupling to the top end of the bent hollow pole mount, with the pole end shown as including equal spaced lugs and stub axles projecting outwardly from its ball end base and a collar as a universal coupling and showing a threaded rod extending out from the top of the eccentric that is passed through the lower bearing, turbine housing, upper bearing and turbine to receive a lock nut turned thereover as the turbine torque mounting to the sander bearing assembly and eccentric.
Figure 5:
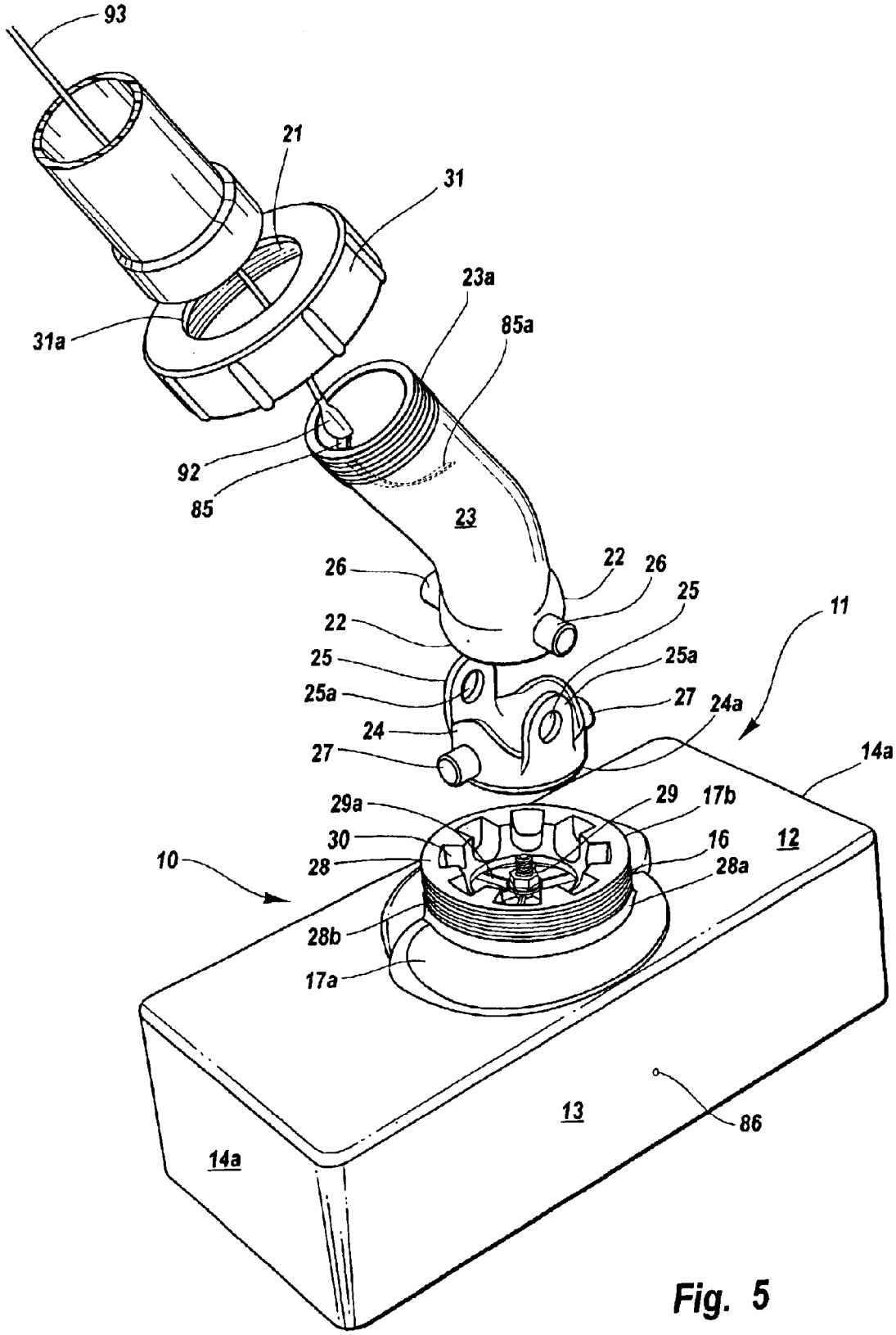
FIG. 5 is an exploded view of the vacuum sander of FIG. 1 showing the collar mounted onto the sander top to include radially spaced slots formed therein that are to receive the stub axles of a collar of the bent hollow pole mount fitted therein as a vertical pivot mounting of the pole to the sander head, and showing spaced lugs extending outwardly from the sides of the ball end of the bent hollow pole mount that are fitted, as pivots into ears of the collar, allowing for tilting the sander head across the pole end, with the stub axles and lugs providing a universal joint that is contained to the sander top by a cap turned over the threaded collar exterior surface that is shown exploded from the collar.

The hollow bent tube 23, as shown in FIGS. 2, 4 and 5, has a ball section 22 lower end that mounts to a collar 24. The collar 24 upper surface is open to fit and slide over the ball section 22 lower end, includes a curved inner surface

24*a* and has a ball section shaped outer surface 24*b* having ears 25 formed thereto that extend essentially parallel to one another from the collar upper edge. Which ears each have holes 25*a* formed therethrough that align with one another and are each to receive a lug 26 of a pair of lugs 26 that are formed to extend outwardly, from opposite sides, of the hollow bent tube 23 ball section 22. So arranged, the lugs 26 are fitted into the ears 25 holes 25*a* as a pivot mounting that allows for a pivoting of the hollow bent tube 23, at its ball section end 22, across the collar 24, moving the hollow bent tube 23 across the collar 24.

The collar 24 includes a pair of stub axles 27 for mounting the hollow bent tube 23 onto the sander housing 11 that extend from opposite sides of the collar 24 outer surface, and are on line with one another. To provide which coupling, the respective stub axles 27 are positioned in the coupling collar assembly 16 that extends upwardly from between the turbine ducts 17*a* and 17*b*, as shown best in FIGS. 1 and 5. Which turbine ducts 17*a* and 17*b* are shown as oval sections formed that are in the housing 11 top 12, on opposite sides of a coupling collar assembly 16 cylinder 28 base 28*a*. The cylinder 28, as shown best in FIG. 5, has a center hole 29 that opens into the turbine ducts 17*a* and 17*b*, and a lower edge 29*a* of that has a concave curved surface that serves as a seat that the end of the collar 24 ball section shaped outer surface 24*a* fits against, with the combination of concave curved surface and ball section shaped outer surface providing a ball and seat coupling of the hollow bent tube 23 to the sander coupling collar assembly 16. For which collar 24 equal spaced radial slots 30 are formed in the cylinder 28, extending radially outwardly from around the hole 29, that are for individually receiving each of the stub axles 27. The stub axles are contained in the individual radial slots 30 by turning a cap 31 thereover that is internally threaded at 32, as shown in FIG. 5, for turning over outer threads 28*b* of cylinder 28. With the stub axles 27 contained by cap 31 within individual radial slots 30 a pivot mounting of the sander body 11 onto the hollow bent tube 23 is provided that allows the sander housing to be pivoted across the hollow bent tube 23 and collar 24. For pivoting of the sander body 11 up and down on the hollow bent tube 23 the lugs 26, that extend outwardly from the hollow bent tube ball section 22, are fitted into collar 24 ears 25 holes 25*a*, providing the pivot coupling. So arranged, the pivot coupling of the hollow bent tube ball section 22 provides a ball and seat coupling to collar 24. Which collar 24 has an upper or top end that has curved surface 24*a* to function as a ball section that is for fitting onto the cylinder 28 hole 29 curved edge 29*a*, also functioning as a ball and seat mounting. The ball and seat mountings, as set out above, are to contain, with minimum leakage, a vacuum air flow passed therethrough. So arranged, the lugs 26 and stub axles 27 and their mountings, respectively to the collar ears 25 and cylinder cavities 30, shown in FIG. 5 as individual half cylindrical sections, provide a universal joint that allows the sander housing 11 to be pivoted up and down and across the hollow bent tube 23 ball section end 22. To maintain which coupling, the hollow bent tube 23 opposite of top end 23*a* is treaded to receive an interior threaded collar 91 of a pole 90. An operator, holding pole 90, can conveniently pivot the sander head 11 as it is moved up and down and back and forth across a wall surface.

Shown in FIG. 4, the turbine ducts 17*a* and 17*b* direct the turbine exhaust flow into a dome 20 that then passes the flow into the hollow bent tube 23, wherefrom it is exhausted through the connected pole 90 to travel into a vacuum hose, not shown, that passes the flow into a collection container, not shown. As set out above, the stub axles 27 mounted in cylindrical 28 cavities 30 provide a pivot coupling that allows for the sander body 11 to be pivoted across the hollow bent tube 23 end, and, additionally, an operator, by a selection of a particular pair of cavities 30 to receive the stub axles 27, can select a desired mounting angle of the sander head 11 to the hollow bent tube 23 and connected pole 90. So arranged, the sander body 11 position or attitude to the end of pole 90 is selectively positionable relative to the hollow bent tube 23 to facilitate the sander being moved up and down or side to side, as the operator determines.

Sander head 11 positioning, however, is preferably not rigid in that the diameter of hole 31 a through the cap 31 is selected to be somewhat larger or greater the hollow bent tube 23 diameter, as shown in FIGS. 1, 4 and 5, that allows for some movement between which sander body 11 and bent tube 23, as during use of the sander, with the loose fit of the cap hole 31*a* to the hollow bent tube 23 outer surface to minimize a likelihood of damage to the coupling should the sander "stick" to the wall surface. With a likelihood of such damage from sander "sticking" being further mitigated by the universal coupling of the sander housing 11 to the hollow bent tube 23 ball section 22 end., as described above. The sander 10 is equipped with a sanding pad 45, as shown best in FIG. 2, that, as shown in FIG. 4, is of a lesser length and width than the distances between the inner surfaces of housing end walls 14*a* and 14*b* and front and rear walls 13*a* and 13*b*, leaving a space therebetween to allow for passage of a vacuum air flow that is pulled therearound. Which vacuum air flow will both turn a turbine 63 and will pick up sanding dust off of the surface being sanding, entraining that dust in the vacuum air flow, as discussed below. To provide sanding, the sanding pad 45 is fitted with a section of sanding material 46, as shown in FIG. 4, that is maintained thereto, preferably with Velcro type fasteners, adhesive sections, or the like, and with the sanding pad 45 oscillated through an eccentric 72 that is turned by turning of the turbine 63, as set out below.

The sanding pad 45, as shown best in FIGS. 2 and 4, includes a stiff flat rectangular plate 47 that has a front or outer face 47*a* and is arranged for releasably mounting sheets of sand paper, or other sanding material, thereover. The rectangular plate 47 includes identical spiders 48 that each have a head end 49 wherein a center hole is formed are each mounted to the corner of a rear or inner face 47*b*, as shown best in FIG. 2. The spiders 48 each include like spaced straight legs 50 that extend outwardly from around the head end 49, and the spiders opposite ends are secured to the plate inner face 47*b* surface. The straight legs 50 are preferably formed from a semi-rigid plastic, or other appropriate light weight stiff material, to flex and allow the sanding pad 45 to oscillate, moving orbitally while supporting the pad against collapse when pressure is applied to force the sanding pad against a surface to be sanded.

For mounting the sanding pad 45 to the sander body 11, as shown in FIG. 2, screws 51 are each aligned and fitted through holes that are formed through the sanding pad 45, preferably at each of the pad corners, and pass through the individual spider 48. The holes each align with a hole 49*a* that is formed through a spider end 49, as shown in broken lines in FIG. 4. The screws 51 are individually turned into a pier 52 that is formed in, to project outwardly from, the bottom surface 12*a* of the flat top 12, as shown also in FIG. 2. So arranged, with each of the spiders 48 connected at its head end 49 to a pier 52, the sanding pad 45 is suspended on the spider legs 50 allowing the sanding pad 45 to oscillate orbitally when moved by operation of the turbine 63 turning an eccentric 72, as set out below. Which connection of the sanding pad 45 spiders to the undersurface 12*a* of the flat top 12 is a last step in the assembly process where the flat top 12 and sanding pad are fitted to the housing 11, following the installation of the turbine and bearing assembly in the housing 11, as set out herein below.

The housing 11 is preferably formed, as by molding or like methods, to include air intakes or air inlet cavities 55 that are arranged in both ends of the housing 11, and direct inlet air that has passed around the sanding pad 45 into inwardly sloping sections within the housing 11, with the flows vented into a turbine chamber 56, striking blades 80 of the turbine 63. The inlet flows are of approximately the same volume, providing a balanced driving force to turn the turbine 63. The air inlet cavities 55 are each formed in the housing, along with the turbine chamber 56, that, as shown best in FIG. 4, is a cavity formed around a center stanchion 57 and projects upwardly from a chamber floor 58, is formed across the housing interior and is spaced upwardly from where the sanding pad 45 is positioned. Which housing interior chamber floor 58 has the air inlet cavities 55 and a center hole 59 formed therein that an eccentric 72 is fitted in, as set out below.

The stanchion 57, as shown in FIGS. 2 and 4, has an inner turbine chamber wall 60, that is flat across its top surface 61 and includes a bearing cavity 62 formed through that top surface that extends downwardly to the chamber floor 58 with a center hole 59. The bearing cavity 62 is to receiving a pair of like upper and lower turbine bearings 64 and 65 of turbine 63 that align to pass a threaded turbine mounting axle 66 extends therethrough from a top 73 of eccentric 72. To maintain which upper and lower turbine bearings 64 and 65, respectively, the bearing cavity 62, as shown in FIG. 4 is stepped inwardly at 62*a* and 62*b*, providing a ledge 62*c* therebetween, that is for maintaining bearing spacing, and whose opposite ends support each of the turbine bearings.

The turbine mounting axle 66, as shown in FIGS. 2 and 4, is threaded at its top end 66*a* that is passed through the turbine 63 to receive a lock nut 67 turned thereover. Which lock nut 67 preferably includes an interior locking washer arrangement wherethrough the threaded turbine mounting axle 66 end 66*a* is turned, with the washer to resist back turning of the nut. allowing an operator to turn the nut 67 to a desired torque that will not loosen during turbine rotation. So arranged, the eccentric 72 top surface 73 is held tightly against a lower surface of lower turbine bearing 65 that is, in turn, held at its top surface against the lower surface of the bearing cavity 62 ledge 62*c*, with the upper bearing 64 lower surface 71 held tightly against the upper surface of the bearing cavity 62 ledge 62*c*, and with a turbine 63 lower section held tightly onto the upper bearing 64 top surface turning nut 67 turned on the end 66*a* of the threaded turbine mounting axle 66 into tight fitting engagement with a top section of the turbine 63 top section 70, completes the assembly of the stack of the eccentric 72, bearings 64 and 65 and turbine 63. In practice, a torque of a sufficient value to accomplish a tight coupling together of the stack components is applied to the lock nut 67. Then, after a short period of time of turbine 63 turning, the lock nut is re-tightened to a final torque of approximately five (5) inch pounds. Which torque value the nut 67 maintains during operations, completing the tool assembly.

As set out above, the threaded turbine mounting axle 66 extends from a top 73 of eccentric 72 that includes an orbit axle 74. The orbit axle 74 is slightly off set from the axis of the turbine mount axle 66 and is journaled to turn in a cup 76 of a pier 75 that, as shown best in FIG. 4, is formed onto the inner surface of the sander stiff rectangular plate 47. Which pier 75 is formed as a raised section and includes the cup 76 formed therein to be slightly off-set from the disk 74 center. The orbit axle 74 is fitted into a bearing 77 that is maintained the cup 76 of the sanding pad 45. So arranged, turning of the turbine 63 turns the turbine mounting axle 66 that is coupled to the eccentric 72 top end 73, and turns the eccentric axle pin 74. Which eccentric axle pin 74 is journaled in a sanding pad 45 bearing 77 that is mounted in cup 76 of the pier 75. An oscillating motion is thereby imparted into the sanding pad, moving it in an orbital path to, in turn, provide an orbital movement to a sheet of sand material attached to the sander stiff rectangular plate 47 outer surface that is, in turn, in contact with a sheet rock wall surface, sanding that surface.

The turbine 63, like the turbine of the inventor's earlier '985 patent, is preferably a split design, formed in two sections, a lower of which sections has a greater height than the height of the top section. So arranged, the bearing assembly axle bearings 64 and 65 can be easily installed in the bearing cavity 62, with the top axle bearing 64 being fitted into the top end of the bearing cavity 62 sliding along the stepped section 62*a* to come to rest on the top lip of the ledge 62*c*. The lower bearing 65 is fitted through the housing 11 open bottom center hole 59, traveling into the bearing cavity, sliding along the lower stepped section 62*b* to where its edge engages the bottom lip of ledge 62*c*. The turbine 63 is fitted, as shown in FIG. 4, through the open top of housing 11 to rest on the top of the top surface 61 of the stanchion 57. The sanding pad 45 bearing 77 is the mounting cup 76 of the pier 75 that extends upwardly from the sanding pad inner face 47*b*, and, with the eccentric axle pin 74 fitted into which bearing 77, the sanding pad 45 and top 12 are installed to the body 11, as set out above.

The turbine 63 is preferably formed from a hard plastic material, metal, or the like, and the described upper and lower turbine halves are joined together as by an adhesive bonding, by welding, brazing, or the like, with the assembly then fitted, as shown best in FIG. 4, into the housing turbine chamber 56. Blades 80 of the turbine 63 are spaced apart equal distances and are preferably curved to each receive the inlet vacuum air flow at their forward edges 80*a* that with an air flow traveling inward to the blades hub ends. The preferred curve of which blades 80 is shown best in FIG. 3. The spacing distance between which blades 80 is shown as reducing from their inlet ends 80*a* to their exhaust ends.

In practice, an inlet vacuum flow is pulled around the sanding pad 45 and passes, as a balanced air flow, through the air inlet cavities 55 and into the turbine chamber 56 wherein the turbine 63 is journaled to upper and lower bearings 64 and 65. The turbine blades 80 each receive the air flow and react thereto by turning, to turn also the eccentric 72 and its eccentric axle pin 74 that itself turns in bearing 77. Which bearing 77 is fitted in mounting cup 76 and moves, in turn, the sanding pad 45 in an orbital path, sanding a surface. In operation, the inlet vacuum air flow picks up sanding dust off from a working surface during its passage around the sanding pad 45, and then passes through turbine ducts 17*a* and 17*b*, driving the turbine 63. Which vacuum flow contains entrained dust collected therein in that passage, is then exhausted through the hollow bent tube 23, and into and through the pole 90, to pass into a vacuum hose that vents into a collection container.

The vacuum air flow is contaminated with sanding dust that is entrained therein off from the sanded surface and travels around the sanding pad 45 edges. A portion of such dust, in earlier sanders, has tended to find its way into the bearing assembly to, in short order, contaminate the bearings, greatly curtailing turbine turning, and severely limiting the useful life of such sander. This problem was recognized and corrected in the '985 patent of the inventor who provided for securely closing and sealing the bearing cavity 62 by the arrangement of the fitting of the turbine axle 66 head end 67 in the upper turbine half plate 70*a* collar 69 and turning of the axle threaded end 68 into the eccentric top end 73, providing a tight clamping together of the upper and lower turbine halves plates 70 and 71. The upper turbine bearing 64 is thereby tightly clamped between the undersurface of the lower turbine half plate 71 and the upper edge of the stepped section 62*c* of the bearing cavity 62. So arranged, the lower turbine bearing 65 top edge is clamped against the lower edge of the stepped section 62*c*, and has its lower edge held against the eccentric disk 64 top surface. Further, as a significant feature of the invention of the '985 patent, dust is precluded from traveling into the bearing cavity 62, a formation of a passage through the housing that extends from an opening in the bearing cavity 62, and slopes downwardly through the stanchion 57, becomes a horizontal passage through the chamber floor 58, and opens through the housing 11 front 13*a* at opening 86, as shown in FIGS. 1 and 5. In operation, the vacuum inlet flow through into the sander 10 creates less than ambient conditions within housing 11 and the bearing cavity 62, that causes an air flow to be pulled from without the sander and through an opening 86 in the housing wall 13*a* and ultimately travels into the bearing cavity 62. A positive pressure is thereby created within the bearing cavity 62 that prevents dust as contained in the vacuum flow from traveling into the bearing cavity, with that flow also providing a cooling air flow that travels over the bearings 64 and 65. Additionally, the passage can be used to pass oil, fed as drops into the opening 86, that will travel into the bearing cavity, and lubricate the turbine bearings 64 and 65. Passing of a clean air flow from without the sander into the bearing cavity 62 through passage along with a periodic introduction of oil through opening 86, provides the sander 10 with a long and useful life.

The collar 91 of pole 90, as shown in FIGS. 1, 2 and 4 and 5, is internally threaded at 91*a*, as shown in FIG. 4, to turn over a threaded end 23*a* of hollow bent tube 23. A static electricity ground connector, is shown in FIG. 2, as a male bayonet electrical connector 85 that connects to a wire 85*a* to, as shown in broken lines, extends therefrom and is molded into the hollow bent tube. Shown in FIGS. 2 and 5, the male bayonet electrical connector 85 extends from the lip of the threaded end 23*a* of hollow bent tube 23 to pass within the pole collar 91 when it is turned over the hollow bent tube 23 threaded end 23*a*. Prior to which turning of the pole collar 91 onto the threaded end 23*a* of hollow bent tube 23. A female bayonet type connector 92 is shown fitted onto the male connector 85, completing an electrical connection therebetween. The female bayonet type connector 92, as shown in FIGS. 2 and 5, is connected onto an end of a static electricity discharge wire 93 that is preferably the length of, for fitting into the pole 90 to extend within the pole, with the exhaust vacuum air flow to pass over the static electricity discharge wire 93 as it travel along and out of the pole 90. In sander operations, a static electric charge builds up on the sander during sanding operations that is produced by the contact of the orbiting sanding surface on a wall surface, and this charge tends to build up over the sander body and pole surfaces. Such charge can be discharged through an operator when that operator comes in contact with a ground, giving that operator an unpleasant shock. The presence of the static electricity discharge wire 93 that is ultimately connected to the sander housing and extends within the pole 90, approximately the length thereof, provides for a dissipation of that built up charge off from the sander and pole surfaces, and passes such built up charge along the length of the discharge wire 93 into the vacuum flow, precluding a buildup of a charge thereon that could flow through an operator to ground.

In practice, the pole 90, as shown, is preferably an inner pole whereover an outer pole, not shown is telescoped. In which arrangement, the outer pole preferably includes a locking collar, not shown, that is secured to turn across a lower end thereof that it telescoped over the inner pole 90. By turning which locking collar, the outer pole end is urged against the inner pole 90 end, locking the inner and outer poles together. So arranged, a lengthened sander pole is provided, with the outer pole end that is opposite to the locking collar end to include a coupling for connection to a vacuum hose, not shown.

A preferred embodiment of my invention an improved vacuum driven sander has been shown and described above. It will, however, be apparent to one skilled in the art that the above described embodiment may incorporate changes and modifications without departing from the general scope of the invention. Which invention. it should be understood, is intended to include all such modifications and alterations in so far as they come within the scope of the appended claims and/or a reasonable equivalence thereof.

I claim:

1. A vacuum driven sander comprising, a housing formed from a rigid material that includes internal air inlet passages connected into a turbine chamber, a bearing assembly cavity wherein a pair of bearings are mounted that support a vacuum air driven turbine, an output shaft of said turbine connects to an eccentric that provides an orbital motion to a sanding plate, with the vacuum flow vented from said housing through a port centered in said housing top and into a hollow bent exhaust tube; pivoting joint means for mounting said hollow bent tube across said port that has spaced radial cavities formed around said port center and including, as a first pivot mount, a collar having an internal curved section that receives a ball section end of said hollow bent tube as a ball and a lower surface of said collar includes a ball section for fitting into a curved surface of said port, and which said collar includes a pair of stub axles that are spaced equidistant from one another and project oppositely from said collar outer surface that are each for fitting into one of each of a pair of said spaced radial cavities formed around said port, with said first pivot mounting that allowing said housing to be pivoted up and down on said hollow bent tube end, and said collar further includes a pair of ears that are spaced equidistantly apart and extend outwardly from a collar rear edge, and have holes formed therethrough that align with, to individually receive, each of a pair of lugs that are equidistant from one another and extend outwardly oppositely from said hollow bent tube end, forming a second pivot mounting that allows said housing to be pivoted from side to side across said hollow bent tube end; and cap means having a center opening that is to pass said hollow bent tube therethrough and mount over said port, maintaining said collar sub axles in said spaced radial cavities.

2. The vacuum driven sander as recited in claim 1, wherein the housing top includes a cylinder extending upwardly therefrom wherethrough the port is formed and which said cylinder is threaded along its outer surface to receive interior threads of the cap means thereover.

3. The vacuum driven sander as recited in claim 1, wherein the hollow bent tube top end is threaded to receive an internally threaded collar of a hollow pole.

4. The vacuum driven sander as recited in claim 3, further including a first electrical connector that is mounted to extend from the hollow bent tube top end inner surface that is to fit within the internally threaded collar turned thereover; and a static electricity discharge wire that mounts to said first electrical connector, and said static electricity discharge wire extends within the hollow pole.

5. The vacuum driven sander as recited in claim 4, wherein the first electrical connector is a male bayonet type electrical connector, the second electrical connector is a female bayonet type electrical connector and the static electricity discharge wire is a bare copper wire.

6. The vacuum driven sander as recited in claim 5, wherein the static electricity discharge wire extends the length of the pole.

7. The vacuum driven sander as recited in claim 1, wherein the housing is formed as a single rectangular unit to contain the inlet air passages, turbine chamber, a stanchion wherein the bearing assembly cavity is formed and is arranged to receive a housing top section fitted thereover that includes air exhaust chambers that are open to said turbine chamber and the port; and the sanding pad is a flat narrow section that is arranged to receive replaceable sections of sanding material releasably secured to its outer surface and includes spiders, that are flexing couplers and are mounted at corners of a top surface of said flat narrow section inner face, and each said spider has a top end with a screw hole formed therethrough and includes equal spaced legs that extend from each spider top undersurface that connect, at their lower ends, onto the sanding pad inner face, with tops of said spiders to each receive a screw turned therethrough and into the housing top section, mounting said sanding pad onto said housing top section; and the eccentric connects through a rod that extends from the eccentric top surface, and passes through upper and lower bearings of the bearing assembly and through a center axial hole formed through the turbine, with said rod top end to receive a fastener means fitted to engage the top edge of said turbine center hole, coupling together said eccentric top surface upper and lower bearings and turbine.

8. The vacuum driven sander as recited in claim 7, wherein the rod is threaded at its top end to receive a locking nut turned thereover that, once turned onto said threaded rod end, sets a torque to maintain the stack of turbine, bearing assembly and eccentric together, and includes a means for resisting turning said locking nut off of said rod end.

* * * * *